US007654117B2

(12) United States Patent
Barnett

(10) Patent No.: US 7,654,117 B2
(45) Date of Patent: Feb. 2, 2010

(54) SHEER HOSIERY

(76) Inventor: Victoria Barnett, 704 W. 9th St., Lockport, IL (US) 60441

( * ) Notice: Subject to any disclaimer, the term of this patent is extended or adjusted under 35 U.S.C. 154(b) by 0 days.

(21) Appl. No.: 11/596,558

(22) PCT Filed: May 18, 2005

(86) PCT No.: PCT/US2005/017350

§ 371 (c)(1),
(2), (4) Date: Nov. 14, 2006

(87) PCT Pub. No.: WO2005/112673

PCT Pub. Date: Dec. 1, 2005

(65) Prior Publication Data

US 2008/0034479 A1 Feb. 14, 2008

Related U.S. Application Data

(60) Provisional application No. 60/572,795, filed on May 20, 2004.

(51) Int. Cl.
*A41B 11/02* (2006.01)

(52) U.S. Cl. ..... 66/241

(58) Field of Classification Search ..... 2/241, 2/239, 240; 66/178 R, 182, 180, 183, 185, 66/186, 187
See application file for complete search history.

(56) References Cited

U.S. PATENT DOCUMENTS

| | | | |
|---|---|---|---|
| 1,743,998 | A | 1/1930 | Dinkelspiel |
| 2,075,610 | A | 3/1937 | Hemingway |
| 2,166,748 | A | 7/1939 | Bloch |
| 2,974,507 | A | 3/1961 | Foster |
| 3,701,164 | A | 10/1972 | Blore |
| 3,711,866 | A | 1/1973 | Vorberg |
| 4,021,861 | A | 5/1977 | Imboden et al. |
| 4,149,274 | A | 4/1979 | Garrou et al. |
| 4,181,982 | A | 1/1980 | Segovia |
| 4,267,607 | A | 5/1981 | Tino |
| 4,341,097 | A | 7/1982 | Cassidy, Sr. et al. |
| 5,345,613 | A | 9/1994 | Jones |
| 5,509,282 | A | 4/1996 | Ferrell, Jr. |
| 5,671,482 | A | 9/1997 | Alvera |
| 5,737,776 | A | 4/1998 | Jennings |
| 5,768,713 | A | 6/1998 | Crick |
| 5,787,509 | A | 8/1998 | Alvera |
| 6,324,874 | B2 | 12/2001 | Fujimoto |
| 6,457,185 | B1 | 10/2002 | Frazier |
| 6,606,750 | B2 | 8/2003 | Solwey |

*Primary Examiner*—Danny Worrell
(74) *Attorney, Agent, or Firm*—Drinker Biddle & Reath LLP

(57) ABSTRACT

Sheer hosiery (200) is provided that maintains the appearance of conventional sheer hosiery while eliminating the foot discomfort that is typically encountered when wearing conventional sheer hosiery. Embodiments of the sheer hosiery (200) include a sheer leg portion (260) and a foot portion (210) that is affixed to the sheer leg portion (260) and at least partially made of a comfort fabric. The foot portion (210) contacts one or more portions of a wearer's foot, such as, for example, a ball portion and a toe portion, and is hidden from view when the wearer's foot is inserted in footwear. The foot portion (210) may be somewhat thicker than the sheer leg portion (260) but is not so thick as to interfere with the fit of the footwear.

22 Claims, 3 Drawing Sheets

SHEER HOSIERY

FIELD OF THE INVENTION

This invention relates to hosiery and, more particularly, to sheer hosiery that maintain the leg appearance of conventional sheer stockings while eliminating the foot discomfort that is typically encountered when wearing conventional sheer stockings.

BACKGROUND OF THE INVENTION

Conventional sheer hosiery made of nylon, spandex or the like, whether in the form of pantyhose or separate stockings, presents serious comfort issues to their wearers. For example, women who for professional or fashion reasons wear high-heeled footwear (e.g., boots, pump-type shoes, etc.) for extended periods of time often suffer serious foot pain such as in the toes, balls and arch of their feet. This foot pain is at least partially caused by the construction of the footwear that includes an insole that forms a flat surface extending throughout ball and lower toe portions thereof and an upwardly inclined surface extending throughout an arch portion toward a heel portion. Since the heel portion of the shoe is generally raised relative to the ball and toe portion of the shoe, a wearer's weight is unnaturally shifted toward the ball and toe portions of the wearer's foot.

Sheer hosiery (e.g., nylon stockings and pantyhose) that is typically worn in conjunction with such footwear typically worsens foot pain since such hosiery does not provide absorption or ventilation in the foot area. As can be appreciated from FIG. 1, when a person wears high-heeled shoes and sheer hosiery, the person's sole begins to perspire and the perspiration becomes trapped between the person's skin and the hosiery due to the hosiery material's hydrophobicity. The trapped perspiration causes the person's foot to slide generally forward and downward in the hosiery due to the trapped moisture, the lubricity of the sheer hosiery and the footwear's inclined insole and, therefore, the person's toes become curled against the (typically) reinforced toe portion of the hosiery as indicated in FIG. 1 by arrow C. After the person's toes curl, their only recourse for relieving the curling is to remove their shoes and pull the toe portion of the hosiery away from their toes while attempting to avoid tearing or causing runs in the sheer hosiery fabric. However, this solution is only temporary since the person's sole will continue to perspire and the perspiration will remain trapped, thereby causing the same uncomfortable foot sliding and toe curling result. Over time, this may cause the wearer of such footwear and unforgiving hosiery to experience foot problems such as blisters, calluses, hammertoes and the like.

While it is known in the art to dispose an insert (e.g., a cotton pad) within the foot portion of the hosiery (i.e., the insert is interposed between the sheer fabric and the wearer's foot) to absorb foot perspiration, this does not solve the foregoing problems. Such inserts become saturated and trap moisture against the wearer's foot since the sheer hosiery material is hydrophobic and has poor ventilation qualities. The same foot sliding and toe curling thereby results often with the added discomfort due to bunching of the insert in the toe area. It is also known in the art to attach a pad (e.g., by sewing, gluing or the like) to the exterior of the foot portion of the hosiery so that the pad is positioned proximate to the sole of the wearer's foot. However, this method is also ineffective in solving the sliding and toe curling since the sheer hosiery, being generally hydrophobic, does not allow the foot perspiration to substantially escape for absorption by the exterior pad.

Therefore, sheer hosiery that serves the desired purpose of making the wearer's legs look attractive but are comfortable and free of the foregoing drawbacks in the foot area would be welcomed.

BRIEF DESCRIPTION OF THE INVENTION

Unique sheer hosiery is provided that maintains the appearance of conventional sheer hosiery while eliminating the foot discomfort that is typically encountered when wearing conventional sheer hosiery. Embodiments of the sheer hosiery include a sheer leg portion and a lower portion that is affixed to the sheer leg portion and is configured to cover a foot, wherein the lower portion is at least partially made of a comfort fabric. The comfort fabric contacts one or more portions of a wearer's foot, such as, for example, a ball portion and a toe portion, and is hidden from view when the wearer's foot is inserted in footwear.

DETAILED DESCRIPTION OF THE EMBODIMENTS

Figure 1:
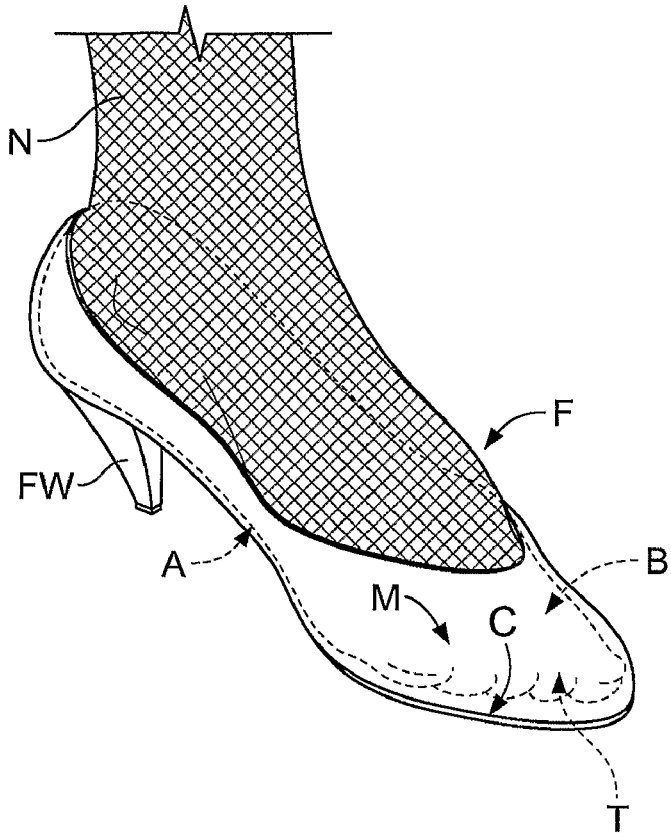
FIG. 1 illustrates an example foot condition resulting from wearing a conventional sheer hosiery article and high-heeled footwear.

Various embodiments are illustrated in the accompanying FIGS. 2-6, but these embodiments are provided for purpose of example and are not intended to be limiting of the invention.

In each of the embodiments at least a portion of the foot area of the sheer hosiery (e.g., stockings, pantyhose) includes a resilient material having at least one of but not limited to the following properties: ventilating, wicking and absorbing. This material will hereinafter be referred to as "comfort fabric" and may be selected from any natural or man-made fibers, fabrics and materials having these desired properties known in the art. Preferred comfort fabrics have a substantial cotton content up to a 100% cotton content for absorbency, but other suitable comfort fabrics include wicking fabrics such as polypropylene, Coolmax® and Supplex®. The sheer hosiery material with which the comfort fabric can be used may be any sheer fabric material known in the art such as nylon, spandex or the like. The hosiery may be any type or style of hosiery known in the art, for example, stockings, pantyhose, control top, full-fashioned, sheer to waist, fishnet, knee-highs, non-control top, support hose, semi-opaque hosiery, thigh high, elongated control top, and tights. As should be appreciated from FIGS. 2-6 and the following description, one aspect of the invention is to provide a wearer of sheer hosiery with improved foot ventilation and moisture (e.g., perspiration) absorption while not interfering with the fit of the footwear and retaining the esthetically pleasing appearance of conventional sheer hose. To this end, the comfort fabric of the various embodiments is permanently attached to the sheer fabric and is worn in the foot area of the hosiery with appropriately selected footwear so that the comfort fabric is hidden from view when the wearer's foot is inserted in the footwear.

As can be appreciated from FIGS. 2-6 the comfort fabric is positioned generally in the foot portion of the sheer hosiery, but may also be positioned proximate to portions of the wearer's leg. The comfort fabric is configured (e.g., shaped, sized, positioned, etc.) to correspond with one or more discrete parts of a wearer's foot, such as the toes, the instep, the ball, the arch and the heel, but the comfort fabric is sized somewhat smaller than an outline of the one or more discrete part of the wearer's foot to which it corresponds. Indeed, one can appreciate that the sheer hosiery has an at least partially "inversely-oriented" construction relative to the footwear, particularly with respect to the positioning of the comfort fabric on the wearer's foot relative to any apertures in the footwear (e.g., in the upper of the footwear). That is, the comfort fabric is configured so that it is positioned on a wearer's foot to avoid one or more apertures in the wearer's footwear through which a part of the wearer's foot is visible, for example, the foot opening, an open toe, an open heel, a fashion aperture (i.e., an opening in the footwear that displays a portion of the wearer's foot) and the like so that the comfort fabric is not visible. In this way, the wearer's footwear and sheer hosiery cooperate to provide an apparel system that keeps the comfort fabric hidden from view. Footwear and sheer hosiery embodiments in accordance with the invention may be paired appropriately by an individual to hide the comfort fabric from view. That is, an individual must either: a) select appropriate footwear according to the position of the comfort fabric in the sheer hosiery that is to be worn, or b) select appropriate sheer hosiery having suitably positioned comfort fabric according to the footwear that is to be worn. In one aspect, a sheer hosiery embodiment may be one or more of displayed, packaged, bundled and sold with appropriate footwear in a retail establishment.

Conventional sheer hosiery (e.g., hosiery made of nylon, spandex or the like), whether in the form of pantyhose or separate stockings, may present serious comfort issues to a wearer of such hosiery, particularly when worn with high-heeled footwear (e.g., pump-type shoes) for an extended period of time. The discomfort is attributable to a number of factors. As can be appreciated from FIG. 1, fashion footwear FW causes unnatural and persistent pressure on the ball B and toe T portions of the wearer's foot F due to the inclined insole construction of the footwear FW. Such a persistent pressure cannot be alleviated by placing cushioning inserts in the footwear or hosiery. Moreover, since conventional sheer hosiery N (FIG. 1) is made of a finely woven hydrophobic material, it does not provide proper ventilation and/or moisture absorption. Thus, such hosiery N causes an undesirable moisture-trapping condition that causes chafing and blisters, generally worsening the foregoing pressure discomfort on the ball B and toe T portions of the wearer's foot F. Further, when conventional hosiery N and fashion footwear FW are worn for an extended period of time, the wearer's foot F will continue to sweat, particularly the ball B and arch A of the foot F, thereby causing perspiration accumulation on the bottom of the wearer's foot F because the trapped moisture is not properly ventilated, wicked, absorbed or the like. The wearer's foot F will then, due to the lubricity of the sheer hosiery and accumulated perspiration, slide forward as indicated by arrow M against the toe portion of the stocking, which will eventually cause the wearer's toes to curl as indicated by arrow C, thereby creating further discomfort and pain to the wearer. As will be explained below, various embodiments of the present invention provide ventilation and moisture absorption in one or more portions of the foot to remedy the foregoing problems caused by foot perspiration without affecting the aesthetic appearance of the sheer hosiery. For example, one embodiment includes toe and sole ventilating/moisture-absorbing portions that can be paired with pump-type shoes so that the toe and sole portions are hidden from view, thereby retaining the conventional appearance of sheer hosiery.

Figure 2:
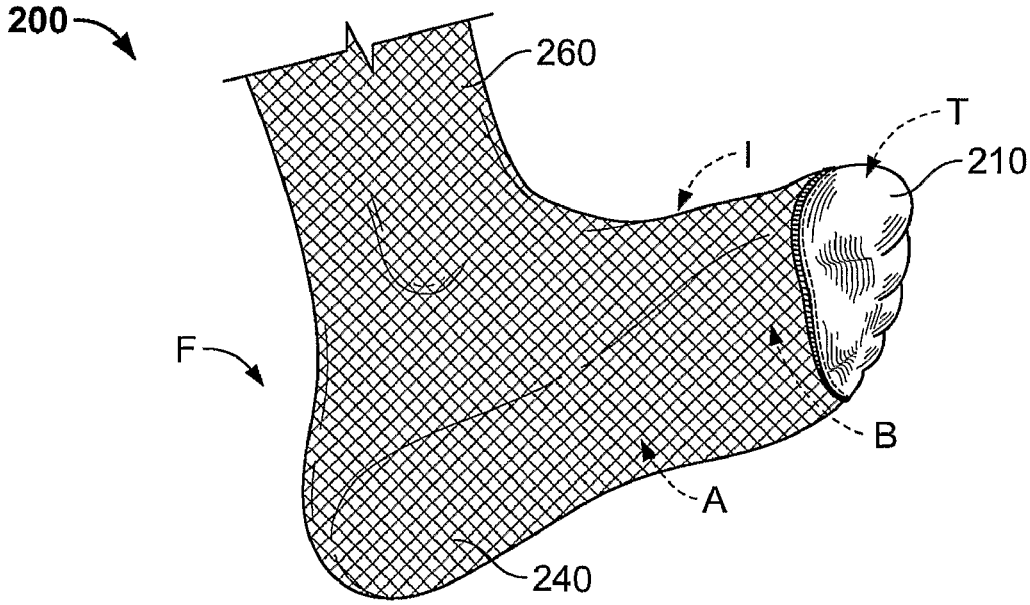
FIG. 2 illustrates a first embodiment of a sheer stocking, which includes a comfort fabric toe portion, in accordance with the present invention.

Turning now to FIG. 2, a first embodiment of sheer hosiery is described. As shown in FIG. 2, the sheer hosiery 200 is illustrated as a sheer stocking or a leg of sheer pantyhose. In this case, the hosiery 200 includes a toe portion 210 that is made of comfort fabric and the hosiery 200 is intended to be worn with closed-toe, pump-type footwear, such as high-heeled dress shoes. The closed toe of the footwear is configured to hide the toe portion 210 when the wearer's foot is inserted in the footwear. Of course, sheer hosiery 200 may be worn with open-toe footwear, but sheer hosiery 300 which will be discussed hereafter is more preferred for wearing with open-toe footwear. As shown, the toe portion 210 has a "toe-let" shape (e.g., bag-like, pouch-like or pocket-like shape) that is attached to the continuous, sheer foot portion 240 and leg portion 260. The toe portion 210 is constructed to cover the tops, bottoms and tips of all the toes of the wearer. That is, the toe portion 210 substantially encloses the wearer's toes, extending from a point on top of the wearer's foot F that is forward of an instep portion I of the foot F, wrapping around the front of the wearer's toes T and terminating at a point proximate a ball B of the wearer's foot F and forward of an arch portion A of the wearer's foot F. Additionally as shown, the top and bottom parts of the toe portion 210 may be connected at their right and left side edges to cover the outer surfaces of the wearer's outer toes (e.g., big toe and pinky toe). Thus, one can appreciate that although the hosiery 200 includes a toe portion 210 that provides comfort to the wearer, the hosiery 200 retains the appearance of conventional sheer hosiery since the toe portion 210 is worn by the wearer on their toes T, which, in turn, are inserted in closed-toe footwear FW, so that the toe portion 210 is hidden from view by footwear FW. This embodiment eliminates or at least greatly reduces toe curling (FIG. 1, arrow C), enhances the freedom of the toes to move generally and limits sliding within the footwear to reduce pain associated with conventional sheer stockings. The comfort fabric wicks moisture produced in the toe area and also absorbs and/or wicks moisture that originates from other areas of the foot (e.g., the ball or arch areas of the foot) that makes its way to the toe area.

The sheer fabric (e.g., foot portion 240 and leg portion 260) and the comfort fabric toe portion 210 may be affixed to each other by any technique that produces a reliable attachment between the sheer fabric and the particular comfort fabric that is chosen. For example, the hosiery 200 may have a one-piece construction with the sheer fabric and the comfort fabric being attached, sewed or integrally knit using an automated process, for example, utilizing a circular knitting machine or the like. However, the hydrophobic threads of the sheer fabric should not be interwoven with the toe portion 210. In some examples the sheer fabric and the comfort fabric may be fastened together by sewing. In other cases, a liquid or other adhesive could be used to attach the fabrics. In still further cases, a heat-sensitive bonding material or tape may be positioned between the two fabrics and heat applied to produce the desired affixation. It should be understood that the sheer fabric should only minimally overlap the toe portion 210 and that the interconnection between the two fabrics should be durable and strong but preferably substantially imperceptible to the wearer. Other methods of affixation may be suitable and will be apparent to those of ordinary skill in the art.

Additionally, one can appreciate that the comfort fabric toe portion 210 is generally thicker or having a higher denier relative to the sheer fabric. However, it is essential in this embodiment that the comfort fabric toe portion 210 not be so thick as to interfere with the fit of the footwear, for example, causing the footwear to feel undersized or unduly tight in the toe area. It is therefore required in the practice of this embodiment that the foot and leg portions 240, 260 of the hosiery 200 be in the sheer range as known in the art (e.g., made of a yarn from about ten to forty denier), whereas the comfort fabric has a thickness in the range of about 0.015 inches to about 0.065 inches. More preferably, the comfort fabric has a thickness in the range of about 0.02 inches to about 0.03 inches. In fact, test subjects wearing prototypes of this embodiment having various thicknesses for toe portion 210 found that prototypes having a comfort fabric toe portion 210 with a thickness greater than about 0.065 inches were too uncomfortable to wear with properly fitting closed-toe, high-heeled fashion footwear. In one example, the hosiery 200 includes a sheer fabric that is made of nylon yarn having a denier of ten and a comfort fabric toe portion 210 that is made of cotton yarn of a greater denier than the nylon yarn and having a thickness of about 0.02 inches.

Figure 3:
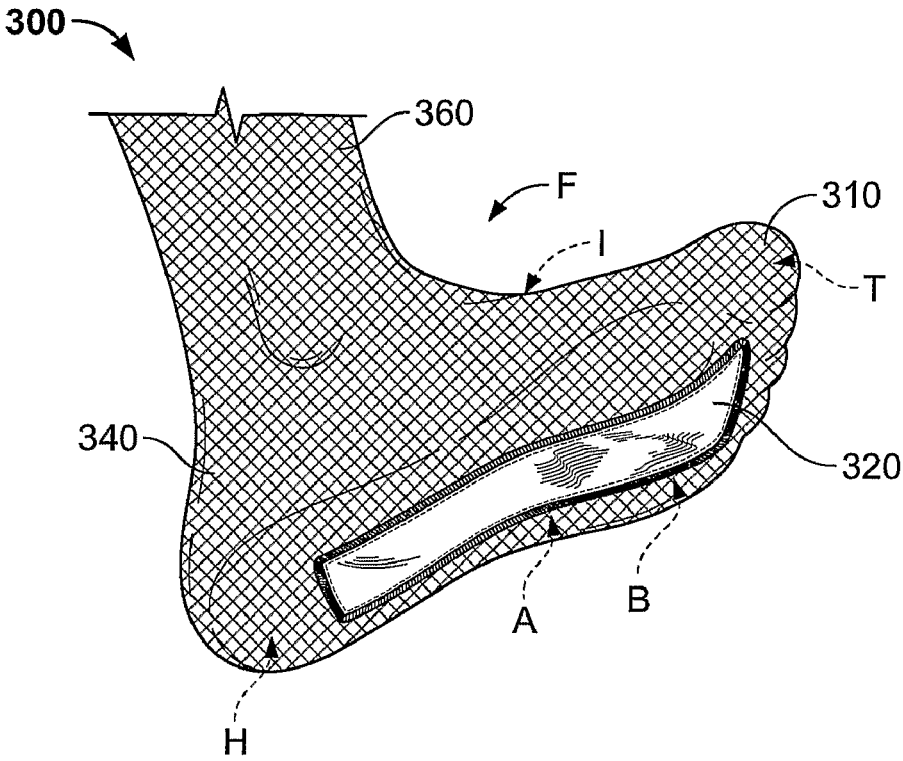
FIG. 3 illustrates a second embodiment of a sheer stocking, which includes a comfort fabric sole portion, in accordance with the present invention.

Referring now to FIG. 3, a second embodiment of sheer hosiery is described. As shown in FIG. 3, the sheer hosiery 300 is illustrated as a sheer stocking or a leg of sheer pantyhose. In this embodiment, the sheer hosiery 300 includes a sheer toe portion 310 and a sole portion 320 that is made of comfort fabric so that the sheer hosiery 300 can be worn with open-toe footwear, such as open-toe, high-heeled dress shoes or the like. Of course, the sheer hosiery 300 may be worn with closed-toe footwear, but previously described sheer hosiery 200 and sheer hosiery 400 which will be discussed hereafter are more preferred for wearing with closed-toe footwear. The sole portion 320 is attached to the continuous, sheer toe portion 310, sheer foot portion 340 and sheer leg portion 360, which provide the sheer hosiery 300 when worn with open-toe, high-heeled dress shoes with the appearance of a conventional sheer hosiery article. The sole portion 320 is dimensioned to contact a portion of the wearer's sole (e.g., ball B, arch A or heel H of the foot F) but remain hidden from view when viewing the wearer's foot F from the sides and back. For example, if an individual wishes to wear footwear with an upper having one or more of an open-toe, open-heel, latticework or straps, the individual puts on the hosiery 300 positioning the sole portion 320 along the bottom of the individual's foot and then inserts their foot in the footwear so that the insole of the footwear hides the sole portion 320. Thus, as previously mentioned, the sheer hosiery 300 and footwear have an inversely-oriented construction so that they cooperate to generally preserve the appearance of conventional sheer hosiery in all of the exposed areas of the wearer's foot, such as portions of the wearer's foot (e.g., the instep I) that are proximate the periphery of the foot opening of the footwear upper in which the foot rests.

As shown, the sole portion 320 is embodied as a generally rectangular-shaped panel or strip, but may be shaped otherwise. For example, the sole portion 320 may have any suitable curvilinear shape known in the art, such as a trapezoid, parallelogram, square, circle, s-shape, zigzag and the like and it may be of either a regular or an irregular shape. The illustrated sole portion 320 extends from a forward point on the sole of the wearer's foot F that is proximate either a base of the wearer's toes T or the ball portion B of the wearer's foot F, to a rearward point on the sole of the wearer's foot F that is proximate either the wearer's heel H or the wearer's arch A. Thus, the sole portion 320 substantially covers the length of the bottom of the wearer's foot. Additionally, in some versions, the sole portion 320 may substantially extend across the entire width of the wearer's sole. Moreover, in some cases, the sole portion 320 may extend partially up the sides of the wearer's foot F so long as the sole portion 320 is hidden from view from the side when the wearer dons cooperating footwear. For example, when an individual intends to wear open-back or strap-heeled footwear such as shoes, clogs, sandals, mules or the like that allow the individual's foot a degree of movement away from the insole, the sole portion 320 of the sheer hosiery 300 may be constructed to extend only from the ball portion B of the individual's foot F to a point intermediate the individual's arch A so that the sole portion 320 cannot be seen from behind when the individual's heel H is raised above the insole of the shoe such as when the individual's weight is on the toes T and ball portion B of the foot F.

This type of sheer hosiery 300 greatly enhances ventilation and moisture absorption/wicking for the wearer's foot, thereby limiting sliding of the wearer's foot within the hosiery 300. To further limit sliding of the hosiery 300 when worn on a wearer's foot that is inserted in footwear, the sole portion 320 may include a friction means (not show) such as a grip, tread or the like. For example, the sole portion 320 may include an integral stitching design as known in the art, such as parallel zigzags that extend across the width of the wearer's sole. In another example the friction means may be a rubber thread, a rubberized appliqué or the like that is attached to a top surface, a bottom surface or both the top and bottom surfaces of the comfort fabric by an affixation means known in the art such as fasteners, sewing, adhesive, heat-transfer and the like. Alternatively, the friction means may be interwoven through a portion or all of the comfort fabric. The comfort fabric sole portion 320 absorbs and/or wicks moisture produced in the area of the wearer's sole (e.g., ball B, arch A, heel H) and may also absorb and/or wick moisture that originates from other areas of the foot (e.g., the toes T) that makes its way to the sole portion 320.

As with the previously described sheer hosiery 200, the sheer fabric (e.g., portions 310, 340, 360) and the comfort fabric sole portion 320 of this sheer hosiery 300 may be affixed to each other by any technique that produces a reliable attachment between the sheer fabric and the particular comfort fabric that is chosen. For example, the hosiery 300 may have a one-piece construction with the sheer fabric and the comfort fabric being attached, sewed, or integrally knit using an automated process, for example, utilizing a circular knitting machine or the like. However, the hydrophobic threads of the sheer fabric should not be interwoven with the sole portion 320. In some examples the sheer fabric and the comfort fabric may be fastened together by sewing. In other cases, a liquid or other adhesive could be used to attach the fabrics. In still further cases, a heat-sensitive bonding material or tape may be positioned between the two fabrics and heat applied to produce the desired affixation. It should be understood that the sheer fabric should only minimally overlap the sole portion 320 to ensure a reliable interconnection therebetween. Further, the interconnection between the two fabrics should be durable and strong but preferably substantially imperceptible to the wearer. Other methods of affixation may be suitable and will be apparent to those of ordinary skill in the art.

Further, as with the comfort fabric toe portion 210 of the first embodiment, one can appreciate that the comfort fabric sole portion 320 is generally thicker or having a higher denier relative to the sheer fabric. However, it is essential that the comfort fabric sole portion 320 not be so thick as to interfere with the fit of the footwear, for example, causing the footwear to feel undersized in the instep and/or toe area. It is therefore required in the practice of this invention that the toe, foot and leg portion 310, 340, 360 of the hosiery 300 be in the sheer range as known in the art (e.g., made of a yarn from about ten to forty denier), whereas the comfort fabric has a thickness in the range of about 0.015 inches to about 0.065 inches. More preferably, the thickness of the comfort fabric is in the range of about 0.02 inches to about 0.03 inches. In fact, test subjects wearing prototypes of this embodiment having various thicknesses for sole portion 320 found that prototypes having a comfort fabric sole portion 320 with a thickness greater than 0.065 inches were too uncomfortable to wear with properly fitting high-heeled fashion footwear. In one example, the hosiery 300 includes a sheer fabric that is made of nylon yarn having a denier of ten and a comfort fabric sole portion 320 that is made of cotton yarn of a greater denier than the nylon yarn and having a thickness of about 0.03 inches.

Figure 4:
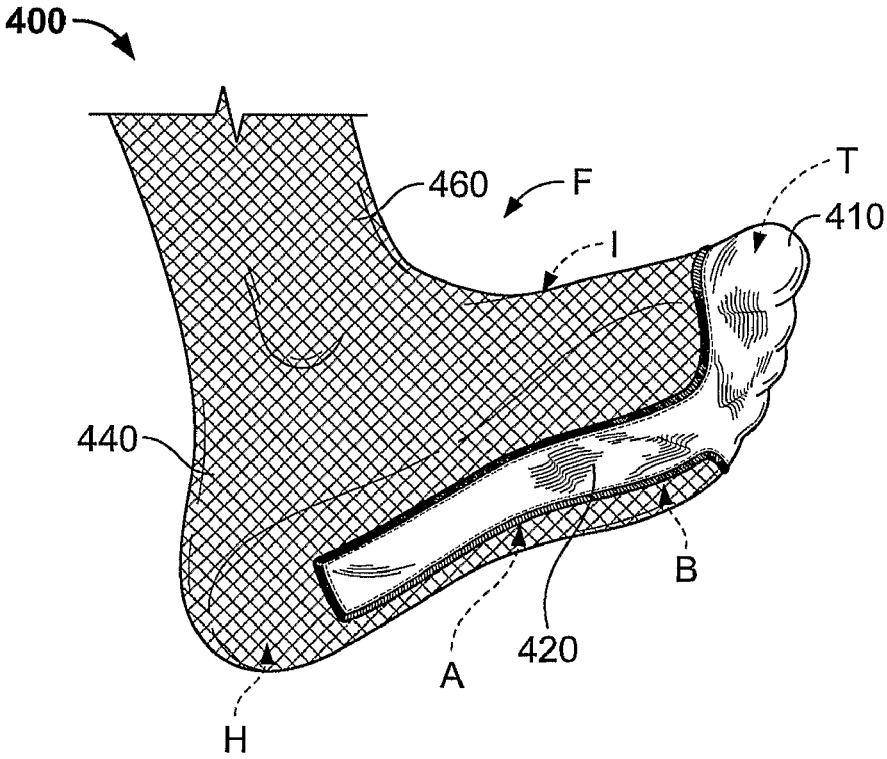
FIG. 4 illustrates a third embodiment of a sheer stocking, which includes a comfort fabric toe and sole portion, in accordance with the present invention.

Referring now to FIG. 4, a third embodiment of sheer hosiery is described. As shown in FIG. 4, the sheer hosiery 400 is illustrated as a sheer stocking or a leg of sheer pantyhose. In this case, one should appreciate that the sheer hosiery 400 generally combines the comfort fabric features of toe portion 210 of the sheer hosiery 200 (FIG. 2) and comfort fabric sole portion 320 of the sheer hosiery 300 (FIG. 3), and is to be worn with closed-toe pump-type fashion footwear, such as high-heeled, closed-toe dress shoes or the like. Although the sheer hosiery 400 can be worn with open-toe footwear, as can be appreciated, the sheer hosiery 400 cooperates with closed-toe footwear to ensure that the sheer hosiery 400 has the appearance of conventional sheer hosiery. As shown, the sheer hosiery 400 includes a toe portion 410 that is made of comfort fabric and a sole portion 420 that is made of comfort fabric. The comfort fabric toe portion 410 is dimensioned to cover the tops and bottoms of all the toes of the wearer. That is, the toe portion 410 substantially encloses the wearer's toes, extending from a point on top of the wearer's foot F that is forward of an instep portion I of the foot F, wrapping around the front (tips) of the wearer's toes T and terminating at a point proximate a ball B of the wearer's foot F and forward of an arch portion A of the wearer's foot F. Additionally as shown, the top and bottom parts of the toe portion 410 may be connected at their right and left side edges to cover the outer surfaces of the wearer's outer toes (e.g., big toe and pinky toe). The sole portion 420 is dimensioned to contact a portion of the wearer's sole (e.g., ball B, arch A or heel H of the foot F) but remain hidden from view when viewing the wearer's foot F from the sides and back. Thus, as previously mentioned, the sheer hosiery 400 has an inversely-oriented construction relative to footwear so that the comfort portions 410, 420 avoid apertures in the footwear, thereby hiding the comfort portions 410, 420 from view. One can appreciate that toe and sole portions 410, 420 are attached to the continuous, sheer foot portion 440 and leg portion 460, which provide the sheer hosiery 400 with the appearance of a conventional sheer hosiery article. This sheer hosiery 400 generally preserves the appearance of conventional sheer hosiery in all of the exposed areas of the wearer's foot, including portions of the wearer's foot proximate the periphery of the opening of the footwear in which the foot rests.

The toe and sole portions 410, 420 may be separated, attached together or may have a one-piece construction. Further, the toe portion 410 and the sole portion 420 may be of the same comfort fabric or different comfort fabrics. For example, the toe portion 410 may be thinner for providing a better fit when wearing narrow-toed footwear while the sole portion 420 is more porous and/or thicker for providing more absorbency/wicking to the pores of the sole S of the wearer's foot F. Indeed, many different combinations of comfort fabrics for toe portion 410 and sole portion 420 are possible.

As with the previously described sheer hosiery embodiments 200 and 300, the sheer fabric (e.g., portions 440, 460) and the comfort fabric toe portion 410 and comfort fabric sole portion 420 of this sheer hosiery 400 may be affixed to each other by any technique that produces a reliable attachment between the sheer fabric and the particular comfort fabric that is chosen. For example, the hosiery 400 may have a one-piece construction with the sheer fabric and the comfort fabric being attached, sewed, or integrally knit using an automated process, for example, utilizing a circular knitting machine or the like. However, the hydrophobic threads of the sheer fabric should not be interwoven with the toe and sole portions 410, 420. In some examples the sheer fabric and the comfort fabric may be fastened together by sewing. In other cases, a liquid or other adhesive could be used to attach the fabrics. In still further cases, a heat-sensitive bonding material or tape may be positioned between the two fabrics and heat applied to produce the desired affixation. It should be understood that the sheer fabric should only minimally overlap the toe and sole portions 410, 420 to ensure a reliable interconnection therebetween. Further, the interconnection between the two fabrics should be durable and strong but preferably substantially imperceptible to the wearer. Other methods of affixation may be suitable and will be apparent to those of ordinary skill in the art.

Since the comfort fabric of this embodiment provides substantial coverage of the wearer's toes T and sole (e.g., ball B, arch A, and heel H) of the wearer's foot F, the sheer hosiery 400 provides maximum comfort to the wearer when donning fashion footwear. The toe portion 410 inhibits toe curling (FIG. 1, arrow C) and provides ventilation and moisture absorption to the wearer's toe area T, ball portion B and arch portion A of the wearer's foot F. Further, the sole portion 420 provides ventilation and absorption/wicking to additional foot surface area, thereby providing stability and inhibiting the previously described sliding effects. As with the previously described sheer hosiery 200, 300, one can appreciate that the comfort fabric toe and sole portions 410, 420 are generally thicker or being of a higher denier relative to the sheer fabric. However, it is essential that the comfort fabric portions 410, 420 not be so thick as to interfere with the fit of the footwear, for example, causing the footwear to feel undersized or unduly tight in the instep and/or toe area. It is therefore required in the practice of this invention that the foot and leg portion 440, 460 of the hosiery 400 be in the sheer range as known in the art (e.g., made of a yarn from about ten to forty denier), whereas the comfort fabric has a thickness in the range of about 0.015 inches to about 0.065 inches. More preferably, the comfort fabric has a thickness in the range of about 0.02 inches to about 0.03 inches. In fact, test subjects wearing prototypes of this embodiment having various thicknesses for toe and sole portions 410, 420 found that prototypes having a comfort fabric portions 410, 420 with a thickness greater than 0.065 inches were too uncomfortable to wear with properly fitting closed-toe, high-heeled fashion footwear. In one example, the hosiery 400 includes a sheer fabric that is made of nylon yarn having a denier of ten and a comfort fabric toe portion 410 that is made of cotton yarn of a greater denier than the nylon yarn and having a thickness of about 0.02 inches and a sole portion 420 that is made of a cotton yarn of a greater denier than the nylon yarn and having a thickness of about 0.03 inches.

Figure 5:
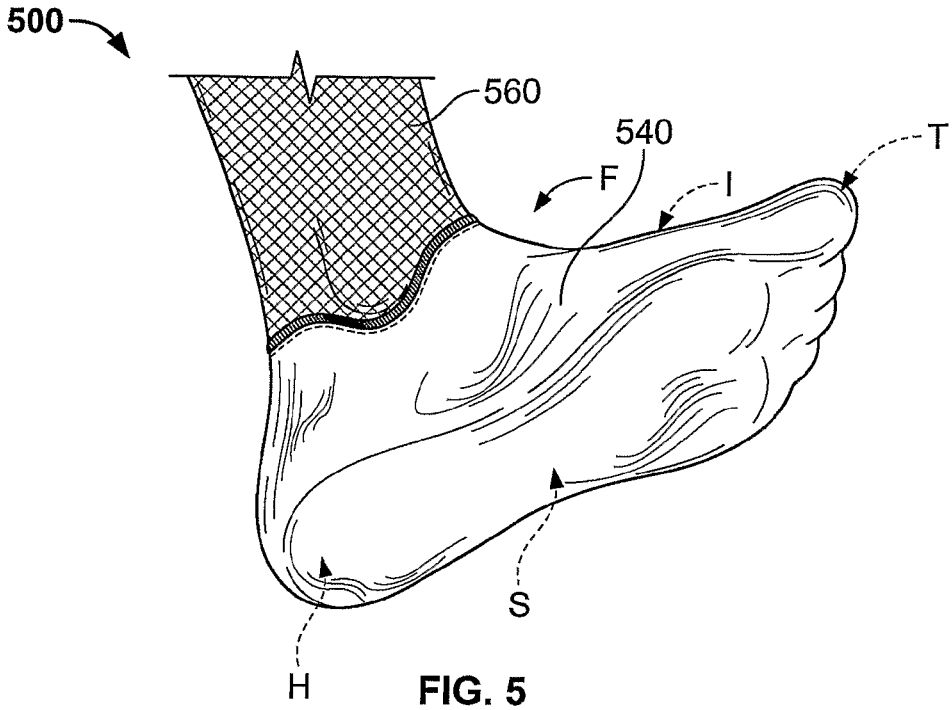
FIG. 5 illustrates a fourth embodiment of a sheer stocking, which includes a comfort fabric foot portion, in accordance with the present invention.

Turning now to FIG. 5 a fourth embodiment of sheer hosiery is described. As shown in FIG. 5, the sheer hosiery 500 is illustrated as a sheer stocking or a leg of sheer pantyhose. As shown, the sheer hosiery 500 includes a foot portion 540 comprising comfort fabric and a leg portion 560 that gives the appearance of a conventional sheer hosiery article. The foot portion 540 may be similar to a footsock, footlet, or "footie" and substantially covers the wearer's foot F (e.g., the toes T, sole S, instep I, heel H) and is particularly comfortable due to the increased amount of comfort fabric in comparison to the foregoing sheer hosiery embodiments 200, 300, 400. However, the sheer hosiery 500 may not be appropriate for fashion footwear such as pump-type shoes where the increased amount of comfort fabric would be visible (e.g., on the instep of the wearer). Further, the thickness of the comfort fabric foot portion 540 is substantially similar to the thickness of commercially-available socks and is not intended to be limited as in the previous embodiments 200, 300, 400. Therefore, due to the foregoing, the sheer hosiery 500 may generally interfere with the fit of fashion footwear and, as such, the sheer hosiery 500 is worn with more casual types of footwear such as low shoes including oxfords, flats, gym shoes, sneakers or the like. For example, the sheer hosiery 500 may be worn by a cheerleader/pom-pom performer, dancer or the like to give their legs the smooth look of sheer hose while greatly reducing foot discomfort and absorbing perspiration while they perform. In another example, the sheer hosiery 500 may be worn by medical personnel (e.g., nurses and laboratory technicians) who wear uniforms including stocking-type hosiery and low-heeled shoes. Such sheer hosiery 500 could also be used with any full-covered shoe or boot. One can appreciate that this embodiment is adapted for use with a broader range of footwear (e.g., casual shoes and boots), but provides the same benefits in terms of comfort etc. and the conventional hosiery appearance that are achieved with the previous embodiments.

Figure 6:
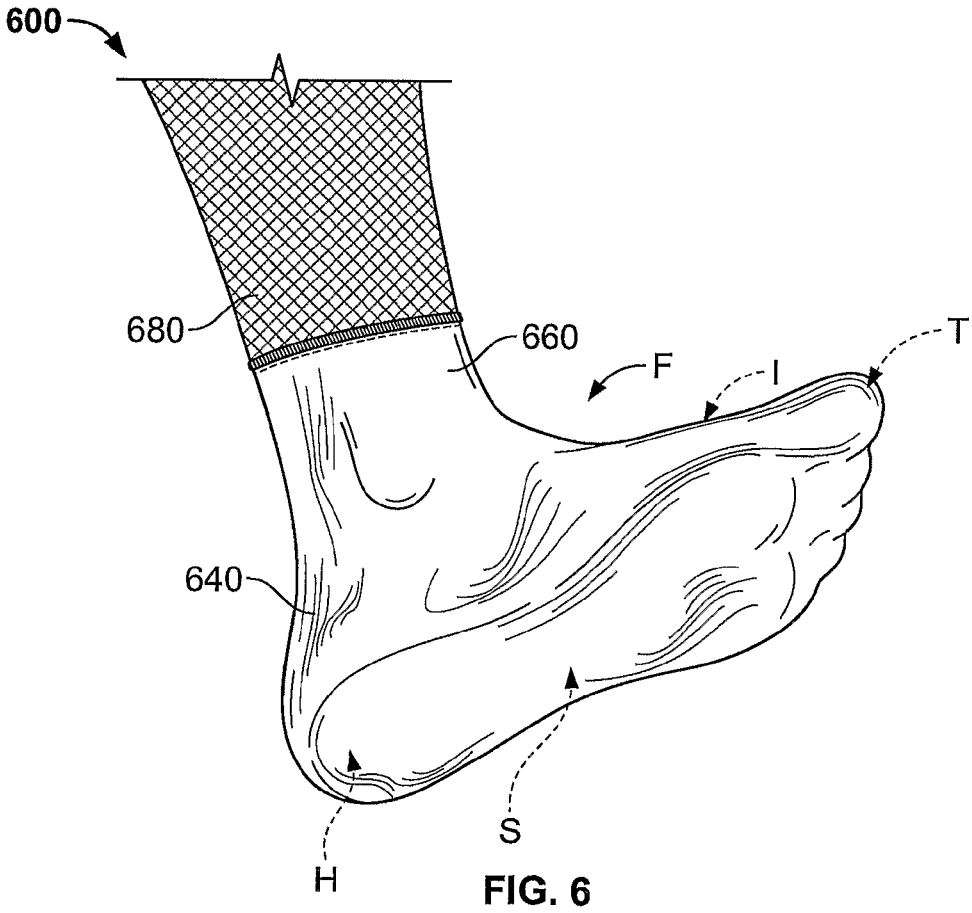
FIG. 6 illustrates a fifth embodiment of a sheer stocking, which includes a comfort fabric foot and leg portion, in accordance with the present invention.

FIG. 6 illustrates yet another embodiment of sheer hosiery in accordance with the invention. As with the sheer hosiery 500 of FIG. 5, the sheer hosiery 600 as shown includes a comfort fabric portion that may be similar to an ankle sock (anklet), athletic sock, crew sock, calf-high sock, mid-calf sock, knee-high sock, slouch sock or the like that substantially covers the wearer's foot (e.g., the toes T, soles S, instep I, heel H), but also covers a portion of the wearer's leg. As illustrated, the sheer hosiery 600 includes a comfort fabric foot portion 640 that covers the entirety of the wearer's foot, a comfort fabric leg portion 660 that covers at least a lower portion of the wearer's leg and a sheer fabric leg portion 680 that extends upward from the comfort leg portion 660 to give the appearance of a convention sheer hosiery article. The comfort fabric leg portion 660 extends upward from the comfort fabric foot portion 640 past the wearer's ankle bone to a point, for example, proximate the wearer's calf. Being somewhat similar to the foregoing sheer hosiery 500, sheer hosiery 600 may not be appropriate for fashion footwear such as pump-type shoes where the increased amount of comfort fabric would be visible (e.g., on the instep, ankle and leg of the wearer). Further, the thickness of the comfort fabric foot portions 640, 660 is substantially similar to the thickness of commercially-available socks and is not intended to be limited as in the previous embodiments 200, 300, 400. Therefore, due to the foregoing, the sheer hosiery 600 may generally interfere with the fit of fashion footwear and, as such, the sheer hosiery 600 is worn with more casual types of footwear such as boots including ankle boots, cowboy boots and the like. Of course, one can appreciate that, in some cases, the comfort fabric leg portion 660 may extend upward, thereby decreasing the sheer fabric leg portion 680, to a point, for example, proximate the wearer's upper calf or knee, so that the sheer hosiery 600 is adapted for wearing with high boots such as knee-high boots. For example, a female dancer wearing a skirt or dress outfit with cowboy boots may wear the sheer hosiery 600 to give the appearance of conventional sheer hosiery above the boot while the hidden comfort fabric foot and leg portions 640, 660 provide foot and leg comfort.

Various example embodiments of this invention are described herein. Variations of those various example embodiments may become apparent to those of ordinary skill in the art upon reading the foregoing description. For example, in further embodiments of the sheer hosiery the comfort fabric may be positioned selectively in the foot area, such as at the heel area, at the instep area, at the arch area, at the tops of the toes, at the front of the toes, at the bottom of the toes and in any combinations of the foregoing. The inventor expects skilled artisans to employ such variations as appropriate, and the inventor intends for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A hosiery article for wearing on a foot and a leg with high-heeled inclined insole fashion footwear to remedy lubricity contributing to forward sliding of the wearer's foot in the footwear while retaining the appearance of sheer hosiery in exposed areas of the foot and leg, the hosiery article comprising:

a lower hosiery foot portion for covering a wearer's foot including the toe portion of the wearer's foot, the hosiery foot portion having a comfort fabric part for absorbing or wicking away potentially lubricating moisture that would otherwise contribute to sliding of the wearer's foot in the footwear, the comfort fabric part being positioned in the foot portion for substantially enclosing the wearer's toes and supporting the wearer's sole; and a leg portion affixed to the lower portion, wherein the remaining part of the hosiery foot portion and the leg portion of the hosiery are made of a sheer fabric containing hydrophobic threads and the leg portion is configured to extend upwardly from the lower portion to cover at least a portion of the leg, in which the hydrophobic threads of the sheer fabric do not extend through the comfort fabric of the lower portion.

2. The hosiery article of claim 1 wherein the comfort fabric part comprises a toelet that substantially encloses the toe portion.

3. The hosiery article of claim 1 wherein the comfort fabric part comprises a panel that substantially covers only the hosiery article sole portion.

4. The hosiery article of claim 3 wherein the panel further comprises a friction means affixed to at least one of a top surface and a bottom surface of the panel for inhibiting at least one of slipping of the foot in the lower portion and slipping of the lower portion in the fashion footwear.

5. The hosiery article of claim 1 wherein the comfort fabric part has a thickness in the range of about 0.015 inches to 0.065 inches.

6. The hosiery article of claim 1 wherein the comfort fabric part has a thickness in the range of about 0.02 inches to 0.03 inches.

7. The hosiery article of claim 1 wherein the comfort fabric part comprises:

a toelet made of a first comfort fabric of a first thickness and having an upper portion that is configured to cover a top of the toe portion and a lower portion that is configured to cover a bottom of the toe portion; and a panel made of a second comfort fabric of a second thickness, the panel being configured to substantially cover the sole portion and having a forward edge proximate to the lower portion.

8. The hosiery article of claim 7 wherein the first comfort fabric is different from the second comfort fabric.

9. The hosiery article of claim 7 wherein the first thickness is different from the second thickness.

10. A hosiery article in accordance with claim 1 further comprising:

a fashion footwear; and a means for at least one of bundling, packaging, displaying and selling the hosiery article with the fashion footwear.

11. A combination hosiery article comprising:

a sock that covers at least one of the entirety of a wearer's foot and a lower portion of a wearer's leg, the sock being made of a comfort fabric that is configured to be hidden from view when the wearer's foot is inserted in footwear; and a generally tubular stocking made of a sheer fabric including a bottom portion that is affixed to the sock, the generally tubular sheer stocking fabric containing hydrophobic threads and extending upwardly from the sock to cover an upper portion of the wearer's leg that is positioned to be visible above the footwear, in which the hydrophobic threads of the sheer fabric do not extend through the comfort fabric of the sock.

12. The combination hosiery article of claim 11 wherein the sock is selected from the group consisting of footlets, anklets, crew socks, athletic socks, calf-high socks, mid-calf socks, knee-high socks and slouch socks.

13. The combination hosiery article of claim 11 wherein the sock further comprises a friction means affixed to a bottom surface of the sock for inhibiting slipping of the foot in the footwear.

14. The combination hosiery article of claim 11 wherein the sock and the generally tubular sheer stocking are integrally knit so that the combination hosiery article has a one-piece construction.

15. A foot and leg apparel system comprising:

a fashion footwear that fits on the foot of a wearer and includes an upper having at least one aperture for revealing a portion of the foot; and a hosiery article to be worn on the leg and on the foot within the fashion footwear by the wearer, the hosiery article including a lower portion configured to enclose the foot and having an affixed comfort fabric part that is positioned on the lower portion away from said at least one aperture and positioned adjacent at least one of a toe portion and a sole portion of the foot, and a leg portion made of a sheer fabric containing hydrophobic threads affixed to the lower portion for extending upwardly from the lower portion to cover at least a portion of the leg of the wearer, the at least one aperture being located away from the toe portion of the footwear, and wherein the fashion footwear cooperates with the hosiery article to hide the comfort fabric part from view while the fashion footwear is worn on the foot, in which the hydrophobic threads of the sheer fabric do not extend through the comfort fabric of the lower portion.

16. The foot and leg apparel system of claim 15 wherein the comfort fabric part comprises a lengthwise panel that is affixed along a bottom portion of the lower portion, the lengthwise panel being configured to substantially cover also the sole portion.

17. The foot and leg apparel system of claim 15 wherein the hosiery article further comprises a friction means affixed to a bottom surface of the lower portion for inhibiting slipping of the foot in the fashion footwear.

18. The foot and leg apparel system of claim 15 wherein the comfort fabric part has a thickness in the range of about 0.015 inches to 0.065 inches.

19. The foot and leg apparel system of claim 15 wherein the comfort fabric part has a thickness in the range of about 0.02 inches to 0.03 inches.

20. The foot and leg apparel system of claim 15 wherein the comfort fabric part comprises:

a toelet made of a first comfort fabric of a first thickness and having an upper portion that is configured to cover a top of the toe portion and a lower portion that is configured to cover a bottom of the toe portion; and a panel made of a second comfort fabric of a second thickness, the panel being configured to substantially cover the sole portion and having a forward edge proximate to the lower portion.

21. The hosiery article of claim 20 wherein the first thickness is different from the second thickness.

22. A hosiery article for wearing on a foot and a leg with high-heeled inclined insole fashion footwear to remedy lubricity contributing to forward sliding of the wearer's foot in the footwear while retaining the appearance of sheer hosiery in exposed areas of the foot and leg, the hosiery article comprising:

a lower foot portion for covering a wearer's foot including the toe portion of the wearer's foot, the toe portion having a comfort fabric part for absorbing or wicking away potentially lubricating moisture that would otherwise contribute to sliding of the wearer's foot in the footwear, the comfort fabric part being positioned in the foot portion for covering the tops, bottoms and tips of the wearer's toes; and a leg portion affixed to the lower portion, wherein the leg portion is made of a sheer fabric containing hydrophobic threads and is configured to extend upwardly from the lower portion to cover at least a portion of the leg;

in which the hydrophobic threads of the sheer fabric do not extend through the comfort fabric of the lower portion.

* * * * *